US007310092B2

(12) United States Patent
Imamura

(10) Patent No.: US 7,310,092 B2
(45) Date of Patent: Dec. 18, 2007

(54) ELECTRONIC APPARATUS, ELECTRONIC SYSTEM, AND DRIVING METHOD FOR ELECTRONIC APPARATUS

(75) Inventor: Yoichi Imamura, Chino (JP)

(73) Assignee: Seiko Epson Corporation, Tokyo (JP)

( * ) Notice: Subject to any disclaimer, the term of this patent is extended or adjusted under 35 U.S.C. 154(b) by 343 days.

(21) Appl. No.: 10/419,807

(22) Filed: Apr. 22, 2003

(65) Prior Publication Data

US 2004/0108998 A1 Jun. 10, 2004

(30) Foreign Application Priority Data

Apr. 24, 2002 (JP) ..... 2002-123036
Apr. 21, 2003 (JP) ..... 2003-116368

(51) Int. Cl.
*G09G 5/00* (2006.01)

(52) U.S. Cl. ..... 345/204; 345/55; 345/36; 345/76; 345/99; 345/103; 345/208

(58) Field of Classification Search ..... 345/204, 345/55, 76, 36, 60, 78, 82, 90, 92, 99, 103, 345/208
See application file for complete search history.

(56) References Cited

U.S. PATENT DOCUMENTS 4,258,384 A * 3/1981 Tatami ..... 386/17
5,521,611 A * 5/1996 Okada et al. ..... 345/89
5,686,936 A 11/1997 Maekawa et al.
5,903,246 A 5/1999 Dingwall
5,952,789 A 9/1999 Stewart et al.
6,091,203 A 7/2000 Kawashima et al.
6,118,439 A * 9/2000 Ho et al. ..... 345/211
6,229,506 B1 5/2001 Dawson et al.
6,229,508 B1 5/2001 Kane
6,236,385 B1 * 5/2001 Nomura et al. ..... 345/95
6,373,454 B1 4/2002 Knapp et al.
6,501,466 B1 12/2002 Yamagishi et al.
2002/0021606 A1 2/2002 Tsuchi

FOREIGN PATENT DOCUMENTS

| | | |
|---|---|---|
| CN | 1278635 A | 1/2001 |
| EP | 0 678 848 A1 | 10/1995 |
| EP | 1 189 191 A2 | 3/2002 |
| JP | A-4-328791 | 11/1992 |
| JP | A-5-265404 | 10/1993 |
| JP | A-295520 | 11/1995 |
| JP | A-8-287821 | 11/1996 |

(Continued)

*Primary Examiner*—Richard Hjerpe
*Assistant Examiner*—Leonid Shapiro
(74) *Attorney, Agent, or Firm*—Oliff & Berridge, PLC

(57) ABSTRACT

An electronic apparatus includes unit circuits provided with electronic devices, data lines connected to the unit circuits, a first output device to output, as a first output, a current or a voltage corresponding to an externally supplied data signal, a second output device to output, as a second output, a current or a voltage corresponding to the magnitude of the first output, and a selection supply device to select one of or both the first output from the first output device and the second output from the second output device and to supply the selected output to the data line. With this configuration, the image reproducibility in a low-luminance/low-grayscale display area of a display apparatus using EL devices is enhanced.

20 Claims, 13 Drawing Sheets

FOREIGN PATENT DOCUMENTS

| | | |
|---|---|---|
| JP | A-9-244590 | 9/1997 |
| JP | A-9-319327 | 12/1997 |
| JP | A-11-8064 | 1/1999 |
| JP | A-11-311978 | 11/1999 |
| JP | A-2001-56667 | 2/2001 |
| JP | A-2001-60076 | 3/2001 |
| JP | A-2001-296837 | 10/2001 |
| JP | A-2002-55659 | 2/2002 |
| JP | A-2002-517806 | 6/2002 |
| JP | A-2003-150104 | 5/2003 |
| WO | WO 98/36407 | 8/1998 |
| WO | WO 99/65011 | 12/1999 |
| WO | WO 01/06484 | 1/2001 |

* cited by examiner

ELECTRONIC APPARATUS, ELECTRONIC SYSTEM, AND DRIVING METHOD FOR ELECTRONIC APPARATUS

BACKGROUND OF THE INVENTION

1. Field of Invention

The present invention relates to a drive circuit for electro-optical devices using organic electroluminescence (hereinafter "EL"). In particular, the invention relates to an enhancement in a driving method of implementing light emission with a precise level of brightness even in a low-grayscale display area.

2. Description of Related Art

A related art method of driving electro-optical devices, such as EL devices, includes an active-matrix driving method in which electro-optical devices can be driven with low power without causing crosstalk, and the durability of the electro-optical devices can be enhanced. Since EL devices emit light with a level of luminance corresponding to the magnitude of a current to be supplied, it is necessary to supply a precise value of a current to the EL devices to obtain a desired level of brightness (see, for example, International Publication No. WO98/36407).

FIG. 13 is a schematic illustrating a display apparatus based on the active-matrix driving method. In this display apparatus, as shown in FIG. 13, scanning lines Vs1 through VsN (N is the maximum number of scanning lines) and data lines Idata1 through IdataM (M is the maximum number of data lines) are disposed in a matrix in a display area to display images. A pixel circuit Pmn ($1 \leqq m \leqq M$, $1 \leqq n \leqq N$) including an EL device is disposed at each intersection of the corresponding scanning line and the data line. The scanning lines Vsn are sequentially selected by scanning circuits, and a data signal corresponding to a halftone value is supplied from a D/A converter to each data line Idatam.

In the display apparatus, however, it takes time to write low-grayscale data signals, and the writing of the low-grayscale data signals may become insufficient.

In particular, the above-described problem becomes noticeable in a method of supplying a data signal having a current level associated with the grayscale. This method is referred to as a "current program method". Since the value of a program current supplied to a data line corresponds to the grayscale to be displayed by a pixel (dot), the amount of current flowing in the data line becomes extremely small for a low grayscale image. With a small value of current, it takes time to charge and discharge the parasitic capacitance of a data line, thereby prolonging the time required to program a predetermined value of current in a pixel circuit. It is thus difficult to complete the data writing during a predetermined writing period (in general, during one horizontal scanning period). As a result, as the light-emission efficiency of EL devices is increased, the program current becomes even smaller, which makes it difficult to program a precise value of current in a pixel circuit.

Additionally, the current value in a low-grayscale display area is a few tens of nA or smaller, which is close to a leak current value of a transistor. Accordingly, the influence of a leak current on a program current cannot be negligible so as to decrease the S/N ratio, thereby lowering the sharpness in the low-grayscale display area of a display apparatus.

Moreover, as the resolution of a display is increased, the number of data lines becomes larger. Accordingly, the number of data lines to connect a pixel matrix substrate and an external driver controller is increased, which makes it difficult to connect the driver controller with the pixel matrix substrate due to a decreased pitch of the data lines. This increases the manufacturing cost of the display apparatus.

SUMMARY OF THE INVENTION

In order to address or solve the above and/or other problems, the present invention provides an electronic apparatus, an electronic system, and a driving method for an electronic apparatus in which images can be displayed with a precise level of brightness even in a low-grayscale display area without increasing the cost.

The present invention provides an electronic apparatus including: unit circuits provided with electronic devices; data lines connected to the corresponding unit circuits; a first output device to output, as a first output, a current or a voltage corresponding to a data signal supplied from outside; a second output device to output, as a second output, a current or a voltage corresponding to the level of the first output; and a selection supply device to select one of or both the first output from the first output device and the second output from the second output device, and to supply the selected output to the data line.

The selection supply device may include at least one switching device. This switching device is used to prohibit or allow the output of one of or both the first output and the second output. In addition to the switching device, a function to vary the output capacity of the selection supply device during a predetermined writing period may be implemented by, for example, an addition circuit.

The data line may include a load device to receive a current flowing in the data line. In this case, it is preferable that the ratio between a constant-current driving capacity of the unit circuit and a current receiving capacity of the load device is substantially equal to the ratio between a current supply capacity of the first output device and a current supply capacity of the second output device. The load device may preferably be disposed at a distal end of the data line when viewed from the second output device. The output device and the load device face each other across the unit circuit. The load device may preferably receive a current flowing in the data line when the selection supply device selects the second current from the second output device and outputs the selected second current to the data line. The load device is a device to receive the current other than the current flowing in the unit circuit when the second current has a large value.

The select supply device may select only the first output from the first output device and supplies the first output to the data line at least during a predetermined last period portion of an output period for which an output is supplied to the electronic device.

The selection supply device may select at least the second output from the second output device at least during a predetermined first period portion of an output period for which an output is supplied to the electronic device.

In this case, the second output device may preferably be configured to output the second output having an output value larger than the output value of the first output from the first output device. This arrangement is desirable to enhance the S/N ratio since programming can be reliably performed with a large current value.

The selection supply device may select at least the second output from the second output device and supplies the selected output to the data line at least during a predetermined first period portion of an output period for which an output is supplied to the electronic device, and the selection supply device may select at least the first output from the first output device during a predetermined last period portion of the output period.

The selection supply device may be configured to supply the output from the first output device and the output from the second output device at substantially the same portion of the data line.

The second output device may output, as the second output, a current or a voltage corresponding to an externally supplied data signal. With this configuration, the second output value can also be set to a certain value based on the data.

A plurality of output supply devices including the first output device, the second output device, and the selection supply device may be provided for one data line, and while one of the output supply devices stores a current value or a voltage value based on the data signal, at least the other one of the output supply devices supplies an output to the data line.

In this case, each of the output supply devices may set two adjacent horizontal scanning periods of a plurality of horizontal scanning periods to be a period to supply an output to the data line, and may set the remaining horizontal scanning periods to be a period to control the unit circuit.

In the above configuration, a predetermined number of unit circuits may form one set, and each of the electronic apparatuses may store a current value or a voltage value based on the corresponding data signal in a corresponding one of sub periods obtained by dividing the horizontal scanning period by a predetermined number.

A pair of unit circuits may be connected to one data line, and one of a pair of control lines to control the output of each of the electronic devices may be connected to the corresponding unit circuit, and the other control line may be connected to the other unit circuit. Control signals having inverted phase portions, which are close or adjacent to each other, may be supplied to the corresponding control lines. According to the control signals having inverted phase portions, which are close to or adjacent to each other, electronic devices disposed adjacent to each other in the direction of the data line can be driven in inverted phases in a short period of time in which a time difference can be visually negligible, thereby making it possible to compensate for the intermittency of pulse driving.

Pulses having a predetermined duty ratio may be continuously output to the control lines. The driving period of the electronic device can be changed by varying the duty ratio.

A pair of control lines may be crossed for the corresponding adjacent unit circuits. With this arrangement, electronic devices disposed adjacent to each other in the direction of the control line can be driven in inverted phases in a short period of time in which a time difference can be visually negligible, thereby making it possible to compensate for the intermittency of pulse driving, for example.

A predetermined number of unit circuits may form a set, and a pair of control lines may be crossed for the set of corresponding adjacent unit circuits. With this configuration, compensation can be made for a predetermined number of unit circuits. This can be applied when, for example, the unit circuits are pixel circuits, and color display by a plurality of primary colors is performed by a combination of a plurality of pixel circuits of the primary colors.

The electronic devices of the present invention may be current driving devices. Alternatively, the electronic devices of the present invention may be electro-optical devices.

The "electro-optical device" is a device that emits light or changes the state of external light according to an electrical action, and includes both a device that emits light and a device to control the transmission of external light. The electro-optical devices include, for example, EL devices, liquid crystal devices, electrophoretic devices, field emission devices (FED) that causes an electron generated by applying an electric field to strike against a light emission plate and to emit light.

The electro-optical device is preferably a current driving element, for example, an electroluminescence (EL) device. The "electroluminescence device" is a device utilizing the electroluminescence phenomenon in which a light emitting material is caused to emit light by recombination energy generated when holes implanted from an anode and electrons implanted from a cathode are recombined by the application of an electric field, regardless of whether the light emitting material is organic or an inorganic (for example, Zn or S). As the layer structure sandwiched by electrodes, the electroluminescence device may include, not only a light-emitting layer formed of a light emitting material, but also one of or both a hole transportation layer and an electron transportation layer. More specifically, the layer structure may include, not only a cathode/light-emitting layer/anode structure, but also a cathode/light-emitting layer/hole-transportation layer/anode structure, a cathode/electron-transportation layer/light-emitting layer/anode structure, or a cathode/electron-transportation layer/light-emitting layer/hole-transportation layer/anode structure.

The present invention also provides an electronic system including the electronic apparatus of the present invention. The "electronic system" is not particularly restricted, and may be television receivers, car navigation systems, POS, personal computers, head mount display units, rear or front projectors, facsimile machines provided with display functions, electronic guideboards, information panels for transportation vehicles and the like, game machines, control panels for machine tools, electronic books, digital cameras, and portable devices, such as portable TV, DSP devices, PDA, electronic diaries, cellular telephones, and video cameras, for example.

The present invention provides a driving method for an electronic apparatus used to supply an output to unit circuits including electronic devices. The driving method includes: outputting, as a first output, a current or a voltage corresponding to an externally supplied data signal; outputting a second output corresponding to the magnitude of the first output; and selecting one of or both the first output and the second output so as to supply the selected output to a data line connected with the unit circuit.

In the supplying of the output to the data line, only the first output may be selected and supplied to the data line at least during a predetermined last period portion of an output period for which an output is supplied to the electronic device.

In the supplying of the output to the data line, at least the second output may be selected and supplied to the data line at least during a predetermined first period portion of an output period for which an output is supplied to the electronic device.

In the outputting of the second output, the second output having an output value larger than the output value of the first output may be output.

In the supplying of the output to the data line, at least the second output may be selected and supplied to the data line during a predetermined first period portion of an output period for which an output is supplied to the electronic device, and at least the first output may be selected and supplied to the data line during a predetermined last period portion of the output period.

In the outputting of the second output, the second output having a current value or a voltage value corresponding to the externally supplied data signal may be output.

At least one of the outputting of the first output or the outputting of the second output may include storing the current value or the voltage value before outputting the first output or the second output.

When a plurality of output supply sets to supply the output, including the first output and the second output, are provided for one data line, while one of the output supply sets performs the storing of the current value or the voltage value, at least the other one of the output supply sets performs the outputting of the output to the data line.

The above-described steps may be performed in two adjacent horizontal scanning periods of a plurality of horizontal scanning periods, and the driving method may include controlling the unit circuits to be performed in the remaining horizontal scanning periods.

In the storing of the current value or the voltage value, the current value or the voltage value may be stored based on the corresponding data signal in each of sub-periods obtained by dividing the horizontal scanning period by a predetermined number.

The present invention provides an electronic apparatus in which a pair of unit circuits provided with electronic devices are connected to a data line, and one of a pair of control lines to control an output of each of the electronic devices at a predetermined duty ratio is connected to the corresponding unit circuit, and the other control line is connected to the other unit circuit. Control signals having inverted phase portions, which are close to or adjacent to each other, are supplied to the control lines.

The present invention provides a driving method for an electronic apparatus, in which outputs of adjacent unit circuits or a pair of unit circuits are controlled by a predetermined duty ratio so that inverted phase portions whose active periods are close or adjacent to each other are provided.

DETAILED DESCRIPTION OF PREFERRED EMBODIMENTS

Exemplary embodiments of the present invention are described below with reference to the accompanying drawings. The following exemplary embodiments are examples only, and are not intended to restrict the application range of the invention.

First Exemplary Embodiment

Figure 1:
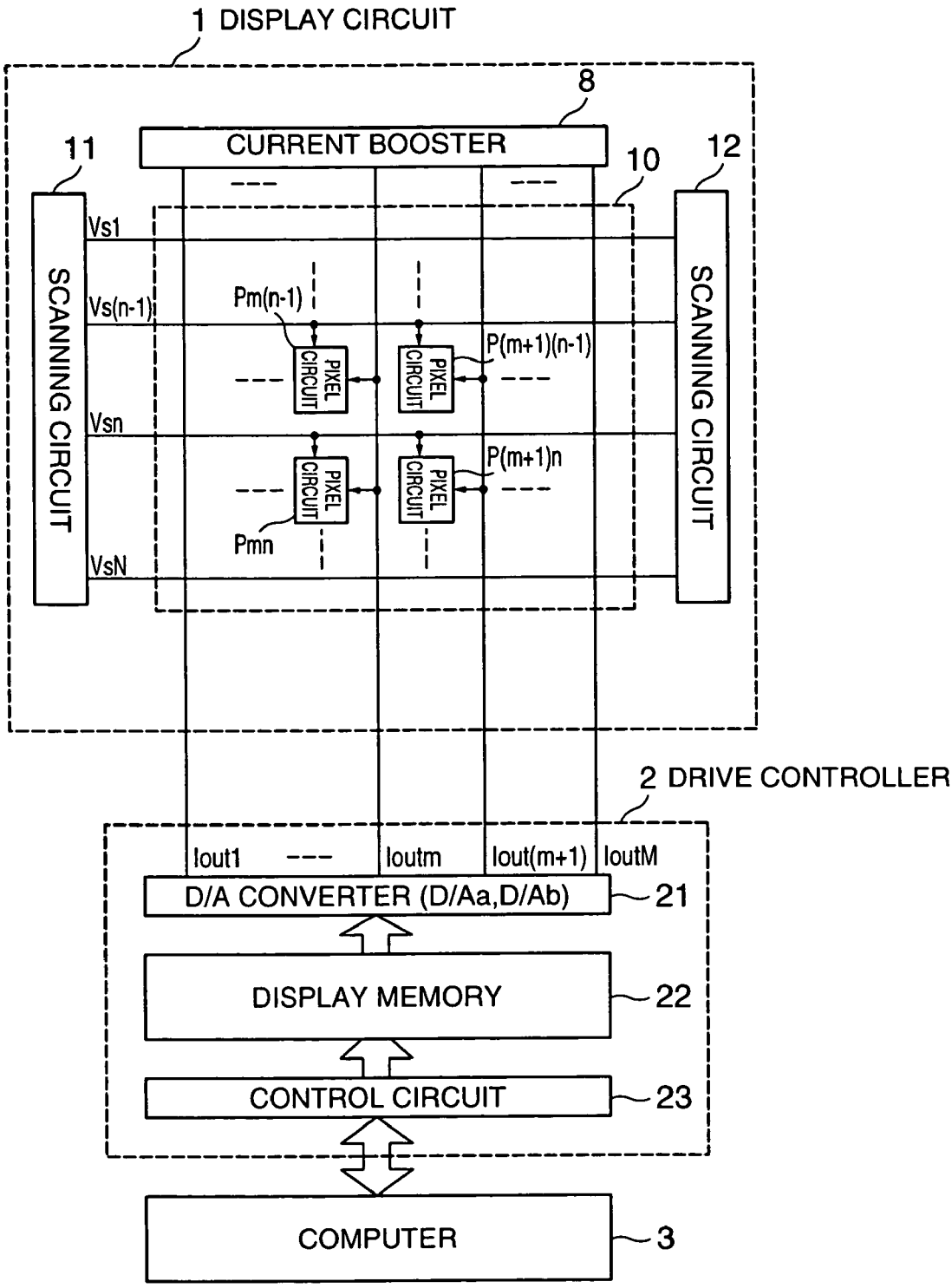
FIG. 1 is a schematic illustrating an electronic system of the present exemplary embodiment.

An exemplary embodiment of the present invention relates to an electro-optical apparatus provided with a drive circuit using EL devices as electro-optical devices. FIG. 1 is a schematic illustrating the overall electronic system including the electro-optical apparatus.

As shown in FIG. 1, the electronic system has a function of displaying predetermined images by using a computer, and includes at least a display circuit 1, a drive controller 2, and a computer 3.

The computer 3 is a general-purpose or dedicated computer, which outputs data (grayscale display data) to cause each pixel (dot) to display a grayscale represented by a halftone to the drive controller 2. For a color image, a halftone provided for a dot that displays each primary color is designated by grayscale display data, and a specific color pixel is generated by synthesizing the designated halftones for the primary colors.

The drive controller 2 is formed on, for example, a silicon single crystal substrate, and includes at least a D/A converter 21 (first and second output devices of the present invention), a display memory 22, and a control circuit 23. The control circuit 23 controls the sending and receiving of grayscale display data to and from the computer 3, and is also able to output various control signals to the individual blocks of the drive controller 2 and the display circuit 1. In the display memory 22, grayscale display data of each pixel (dot) supplied from the computer 3 is stored in correspondence with the address of the pixel (dot). The D/A converter 21 is formed of D/A converters (D/Aa and D/Ab) having two functions for one output, i.e., a high-current output function and a low-current output function. The D/A converter 21 converts grayscale display data, which is digital data read from the address of each pixel of the display memory 22, into a corresponding current value with high precision. The D/A converter 21 is able to simultaneously output the same number of signals Iout as the number of data lines (number of dots in the horizontal direction) with a predetermined timing. The drive circuit 2 and the display circuit 1 include the electronic apparatus of the present invention. A combination of the display circuit 1 and the drive controller 2 has an image display function, and corresponds to the electronic system of the present invention regardless of the presence or the absence of the computer 3.

The display circuit 1 is formed of, for example, a low-temperature polysilicon TFT or an α-TFT, and in a display area 10 for displaying images, select lines Vsn ($1 \leqq n \leqq N$ (N is the number of scanning lines)) are disposed in the horizontal direction and data lines Ioutm ($1 \leqq m \leqq M$ (M is the number of data lines (number of columns))) are disposed in the vertical direction. A pixel circuit Pmn is disposed at each intersection of the corresponding select line Vsn and the data line Ioutm. The display circuit 1 also includes scanning circuits 11 and 12 for selecting one of the select lines, and a current booster circuit B to drive the data lines. In the display area 10, a light-emission control line Vgn (not shown) to control light emission in each pixel circuit Pmn is disposed in correspondence with the select line, and a power line (not shown) to supply power to each pixel circuit is disposed in correspondence with the data line. The light-emission control line corresponds to a control line of the present invention. The scanning circuits 11 and 12 select one of the select lines Vsn in correspondence with a control signal from the control circuit 23, and are able to output a light-emission control signal to the corresponding light-emission control line Vgn. The current booster circuit B corresponds to a load device of the present invention, and is provided with a current booster circuit Bm associated with the data line Ioutm. When viewed from the D/A converter 21, the current booster circuit B is disposed at the opposite side of the data lines, which produces a desirable effect. However, the current booster circuit B may be distributed on the data lines without changing the total driving capacity of the current booster circuit B.

In the above-described configuration, grayscale display data of each pixel read from the display memory 22 is converted into a corresponding current value in the D/A converter 21. When one of the select lines Vsn is selected by the scanning circuits 11 and 12, a program current output to each data line Ioutx is written into the pixel circuit Pxn ($1 \leqq x \leqq S$) connected to the select line.

Figure 2:
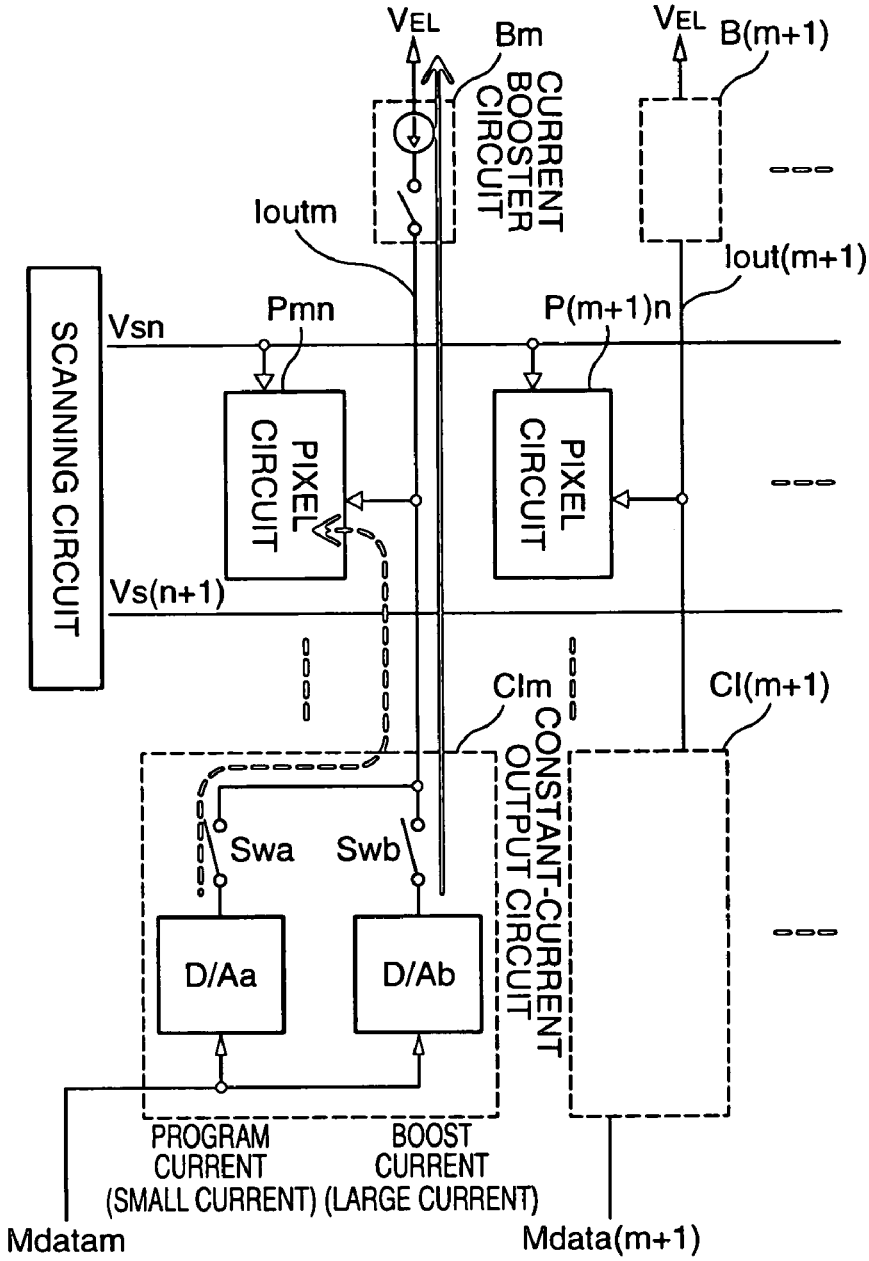
FIG. 2 is a schematic that illustrates an operation principle of a current boost of a first exemplary embodiment.

The basic operation of the first exemplary embodiment of the present invention is described below with reference to FIG. 2. FIG. 2 illustrates the pixel circuit Pmn selected by the select line Vsn, a constant-current output circuit CIm to supply a current to the pixel circuit Pmn, and the current booster circuit Bm in correspondence with a data line in dots (pixels) disposed in a matrix. The constant-current output circuit CIm is formed of two D/A converters, i.e., a first constant-current output circuit D/Aa and a second constant-current output circuit D/Ab, and is able to selectively supply one of or both a program current (output from the first constant-current output circuit D/Aa) and a boost current (output from the second constant-current output circuit D/Ab) which is higher than the program current. The boost current may be, for example, a few times or more, desirably a few tens of times higher than the program current.

In this exemplary embodiment, as shown in FIG. 2, during the current program period to supply the program current to the pixel circuit Pmn, the control circuit supplies at least the boost current in the first part of the current program period and supplies the program current in the second part of the current program period. More specifically, in the first part of the current program period, the control circuit controls a first switching device Swa, which supplies a selection supply device, to be in a non-conducting state, and a second switching device Swb to be in a conducting state, and activates the current booster circuit Bm so as to supply the boost current generated by the second constant-current output circuit D/Ab to the data line Ioutm. In this case, the ratio between the constant-current output capacity of the first constant-current output circuit D/Aa and that of the second constant-current output circuit D/Ab is set to be equal to the ratio between the current reception capacity of the pixel circuit Pmn and that of the current booster circuit Bm. Accordingly, the voltage of the data line changes with respect to the time in accordance with the output current value and the parasitic capacitance value of the data line, and becomes stable around the target voltage value, which would be obtained when the program current is supplied. At this point, by turning off the second switching device Swb and by changing the first switching device Swa to a conducting state, the program current generated by the first constant-current output circuit D/Aa with high precision is supplied to the data line Ioutm. According to this operation, the gate-source voltage Vgs of a transistor T1 (FIG. 3) in the pixel circuit, which would be obtained when the first constant-current output circuit D/Aa supplies the program current by using the pixel circuit as a load, can be reached rapidly and precisely.

As described above, according to the present invention, in the first part of the current program period, by supplying a high current, which is a few times higher than the program current and is proportional to the program current, the voltage of the data line Ioutm can substantially reach a predetermined voltage more rapidly than when only the program current is supplied or when a data line is precharged for a predetermined duration. Then, in the second part of the current program period, the current booster circuit is turned off, and also, only the program current generated by the silicon drive controller 2 with high precision is supplied to the pixel circuit, thereby making it possible to program a precise program current value.

In this exemplary embodiment, only the boost current flows in the first part of the current program period. However, since the program current is smaller than the boost current, the program current may also be supplied in the period during which the boost current is supplied, in which case, the pixel circuit may not be connected to the data line.

Figure 3:
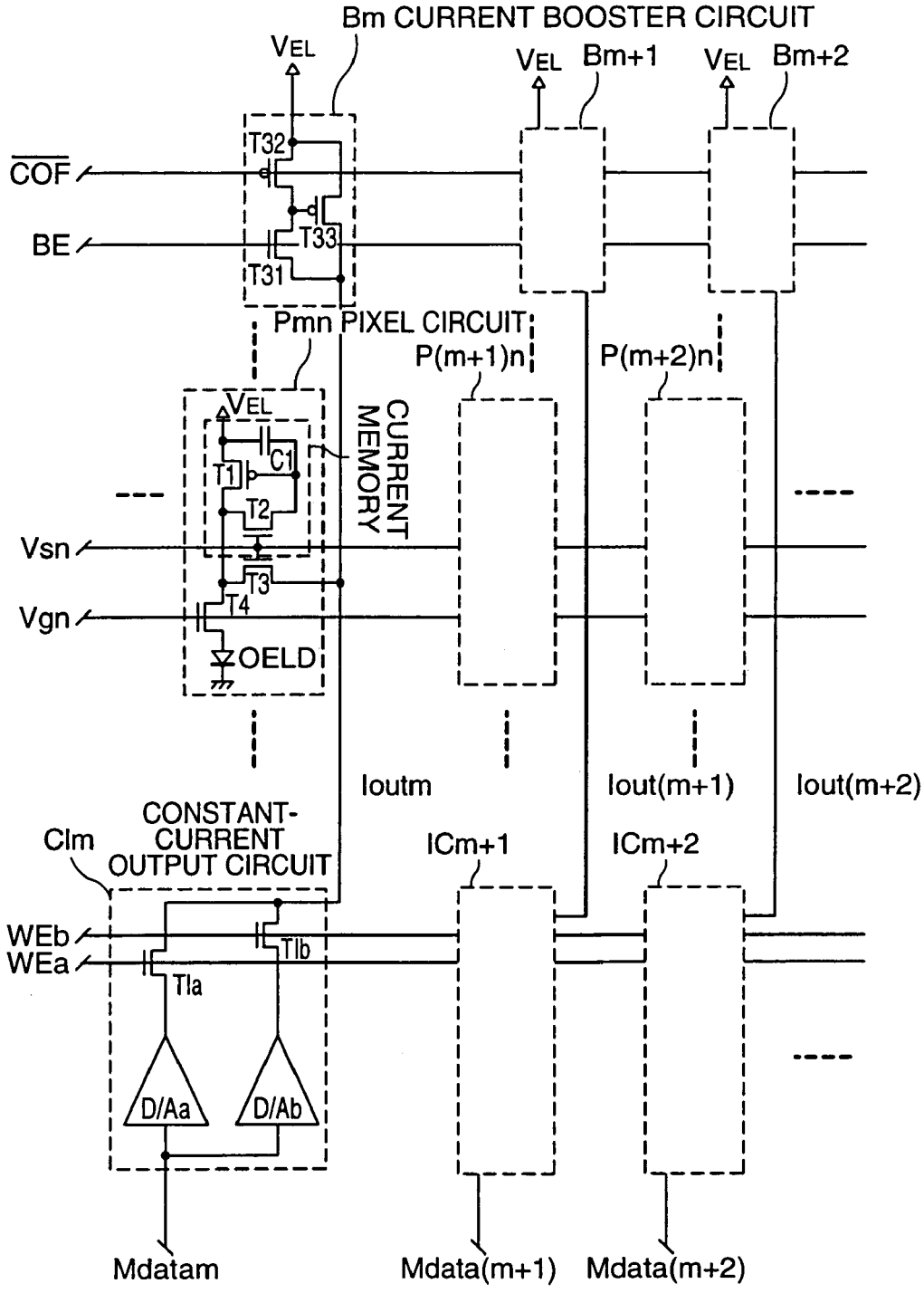
FIG. 3 is a schematic circuit diagram of a drive circuit of the first exemplary embodiment.

FIG. 3 illustrates a more specific configuration of the drive circuit. FIG. 3 illustrates one of the pixel circuits Pmn disposed in a matrix, the constant-current output circuit CIm to supply a current corresponding to grayscale display data to the pixel circuit, and the current booster circuit Bm.

The pixel circuit Pmn is provided with a circuit to retain the value of a program current supplied from the data line and to drive the electro-optical device by the retained current value, that is, a circuit corresponding to the current program method to cause an EL device to emit light.

The pixel circuit Pmn is formed of analog current memory devices (T1, T2, and C1), an EL device OELD, a switching transistor T3 to connect the analog current memory devices and the data line, and a switching transistor T4 to connect the analog current memory devices and the EL device while these elements are connected to each other, as shown in FIG. 3.

With this arrangement of the pixel circuit, during the current program period, the select line Vsn is selected so that the transistors T2 and T3 are changed to a conducting state. When the transistors T2 and T3 are in a conducting state, the transistor T1 reaches the steady state after the lapse of a predetermined duration corresponding to the program current, and the voltage Vgs corresponding to Ioutm is stored in the capacitor C1. During the display period (light emission period), the select line Vsn is not selected, and the transistors T2 and T3 are disconnected. Then, after the constant current on the data line is cut off, the light-emission control line Vgn is selected. As a result, the transistor T4 becomes in a conducting state, and the constant current Iout corresponding to the voltage Vgs stored in the capacitor C1 is supplied to the organic EL device via the transistors T1 and T4, thereby causing the organic EL device OELD to emit light with a luminance level of grayscale corresponding to the program current.

The pixel circuit shown in FIG. 3 is an example only, and another circuit configuration may be applied as long as the current program method is employed.

The constant-current output circuit CIm is provided with a pair of D/A converters including a first current output circuit D/Aa and a second current output circuit D/Ab, and is able to selectively supply one of or both a program current and a boost current, which is higher than the program current. More specifically, the first current output circuit D/Aa to supply the program current and the second current output circuit D/Ab to supply the boost current are connected in parallel with the data line Ioutm. It is preferable that the ratio between the current driving capacity of the first current output circuit D/Aa and that of the second current output circuit D/Ab is set to be equivalent to the ratio between the current driving capacity of the transistor T1 in the pixel circuit and that of a transistor T33 in the current booster circuit. In this case, the transistors T1 and T33 are set so that they perform the saturation area operation by the transistor T2 and a transistor T31. By setting the ratio of the current driving capacity to be equal as described above, the voltage of the data line obtained when the second current output circuit D/Ab supplies the boost current to the data line by using the current booster circuit as a load device becomes substantially equal to the gate-source voltage Vgs of the transistor T1 obtained when the first current output circuit D/Aa supplies the program current by using the pixel circuit as a load. Since the current booster circuit can be formed to be large without being restricted by the dot area, the boost current can be a few times or a few tens of times higher than the program current in all the grayscales. As a result, even in the low-grayscale area in which the program current becomes very small, the voltage of the data line or the gate-source voltage Vgs of the transistor T1 can be rapidly changed to a predetermined value.

The current booster circuit Bm in the current booster B causes a boost current to flow into the data line in cooperation with the constant-current output circuit CIm in the D/A converter 21. More specifically, the current booster circuit Bm includes the transistor T31, a transistor T32, and the transistor T33. The transistor T33 is a booster transistor, and the transistor T31 is a switching device to cause the booster transistor T33 to be in a conducting state in the constant current area in accordance with a booster enable signal BE. The transistor 32 forces electric charges stored in the gate of the booster transistor T33 to be discharged when a charge-off signal is supplied, thereby completely switching off the booster transistor T33. It is preferable, as stated above, that the ratio between the current output capacity of the booster transistor T33 and that of the transistor T1 of the pixel circuit is equal to the ratio of the current output capacity of the second current output circuit D/Ab and that of the first current output circuit D/Aa.

With this configuration, grayscale display data of corresponding dots (pixels) for one horizontal line is output to each display memory output Mdata from the display memory 22 during each scanning period. This grayscale display data is received by the two current output circuits D/Aa and D/Ab, and generate the program current and the boost current, respectively, based on a common reference current source (not shown). When a write enable signal WEa or WEb is supplied, a transistor TIa or a transistor TIb becomes in a conducting state, and one of or both the program current and the boost current are output to the data line from the corresponding current output conversion circuits.

Figure 4:
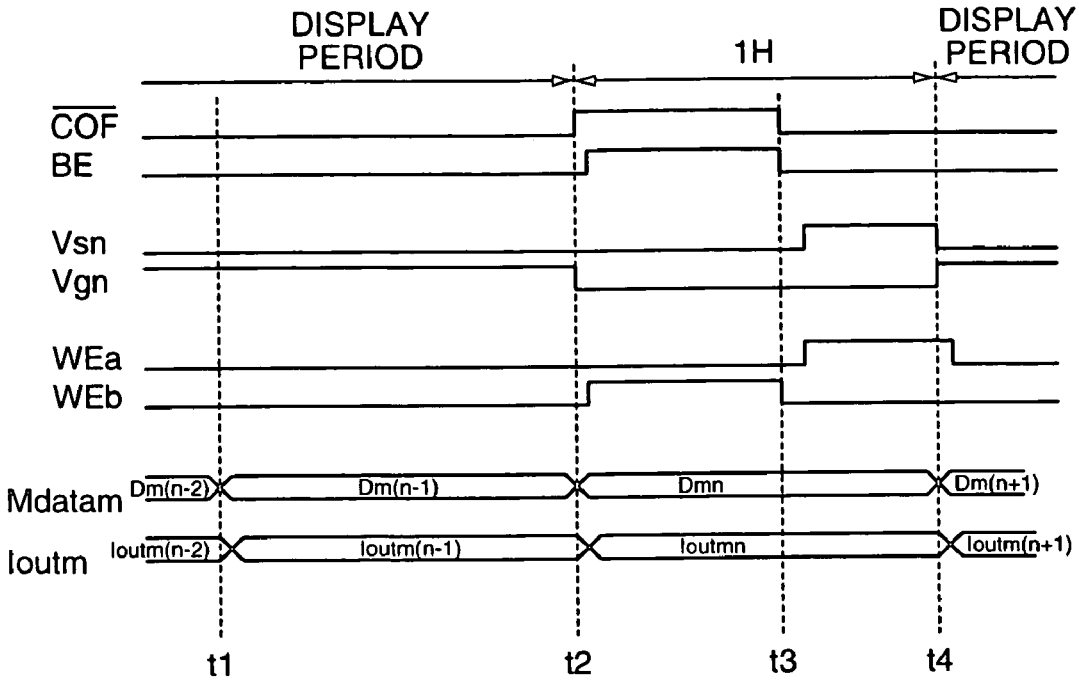
FIG. 4 is a timing chart of the drive circuit of the first exemplary embodiment.

A detailed operation of the first exemplary embodiment shown in FIG. 3 is described below with reference to the timing chart of FIG. 4. The timing chart of FIG. 4 mainly illustrates one horizontal scanning period H of a plurality of horizontal scanning periods which forms a frame period to display an image, current programming being performed for a scanning line n during the horizontal scanning period H. The period 1H corresponds to the current program period. In the current program period, the control circuit shifts the light-emission control line Vgn to the non-selection state to stop the light emission of the organic EL device OELD. The grayscale display data corresponding to each pixel is output to the display memory output line Mdata for every scanning period.

At time t1, when the display memory output line Mdatam sends grayscale display data Dm(n−1) for the pixel Pm(n−1), the D/A converter (current output circuit) receives the grayscale display data Dm(n−1) so as to generate the corresponding program current and boost current.

From time t2, the first half of the current program period for the scanning line n is started. The control circuit enables the write enable signal WEb after time t2 so as to output the boost current to the data line Ioutm from the second current output circuit D/Ab. Since the write enable signal is simultaneously supplied for all the pixels of the scanning line n, the current is output to the data line Ioutm of each pixel. Because of this boost current, even in the low-grayscale display area, i.e., even when the target current value is small and it thus takes time to program such a small current value, the voltage of the data line can substantially reach the target current value in a short period of time. Upon completion of the boost period at time t3, the control circuit disables the write enable signal WEb for the boost current so as to stop the supply of the boost current from the second current output circuit D/Ab. Then, the control circuit enables the enable signal WEa, and simultaneously selects the select line Vsn so that only the program current is supplied to the pixel circuit Pmn during the second part, i.e., the remaining current program period (time t3 to time t4). According to this operation, the target current value can be precisely programmed.

Upon completion of the current program period at time t4, the control circuit shifts the select line to the non-selection state, and simultaneously shifts the light-emission control line Vgn to the selection state, thereby causing a current to flow in the organic EL device OELD of the pixel circuit Pmn. Thus, the current program period is shifted to the display period. In this case, programming by using the enhanced current value has been completed in the pixel circuit Pmn, and a current having the enhanced value is supplied to the EL device OELD, thereby causing the organic EL device OELD to emit light with an enhanced luminance level corresponding to the enhanced current value. As a result, the grayscale of the pixel Pmn is displayed according to the difference of the luminance level.

As described above, according to the first exemplary embodiment, even in a low-grayscale display area having a small program current, a boost current, which is higher than the program current, is used so as to eliminate the problems of the insufficient writing time and the influence of noise, thereby making it possible to display sharp images having enhanced reproducibility.

According to the method of the first exemplary embodiment, a program current can be written into the pixel circuit at high speed. Thus, by providing, for example, a current latch employing the drive circuit method of the present invention between the D/A converter and the pixel circuit, the program current corresponding to a plurality of pixels can be written in a time division multiplexing manner. Accordingly, the number of data lines to connect the drive controller 2 and the display circuit 1 shown in FIG. 1 can be considerably decreased. This is described in detail in the following second exemplary embodiment.

Second Exemplary Embodiment

As described above, the second exemplary embodiment of the present invention is provided with a mode which is further developed from the electronic apparatus and the electronic system of the first exemplary embodiment.

Figure 5:
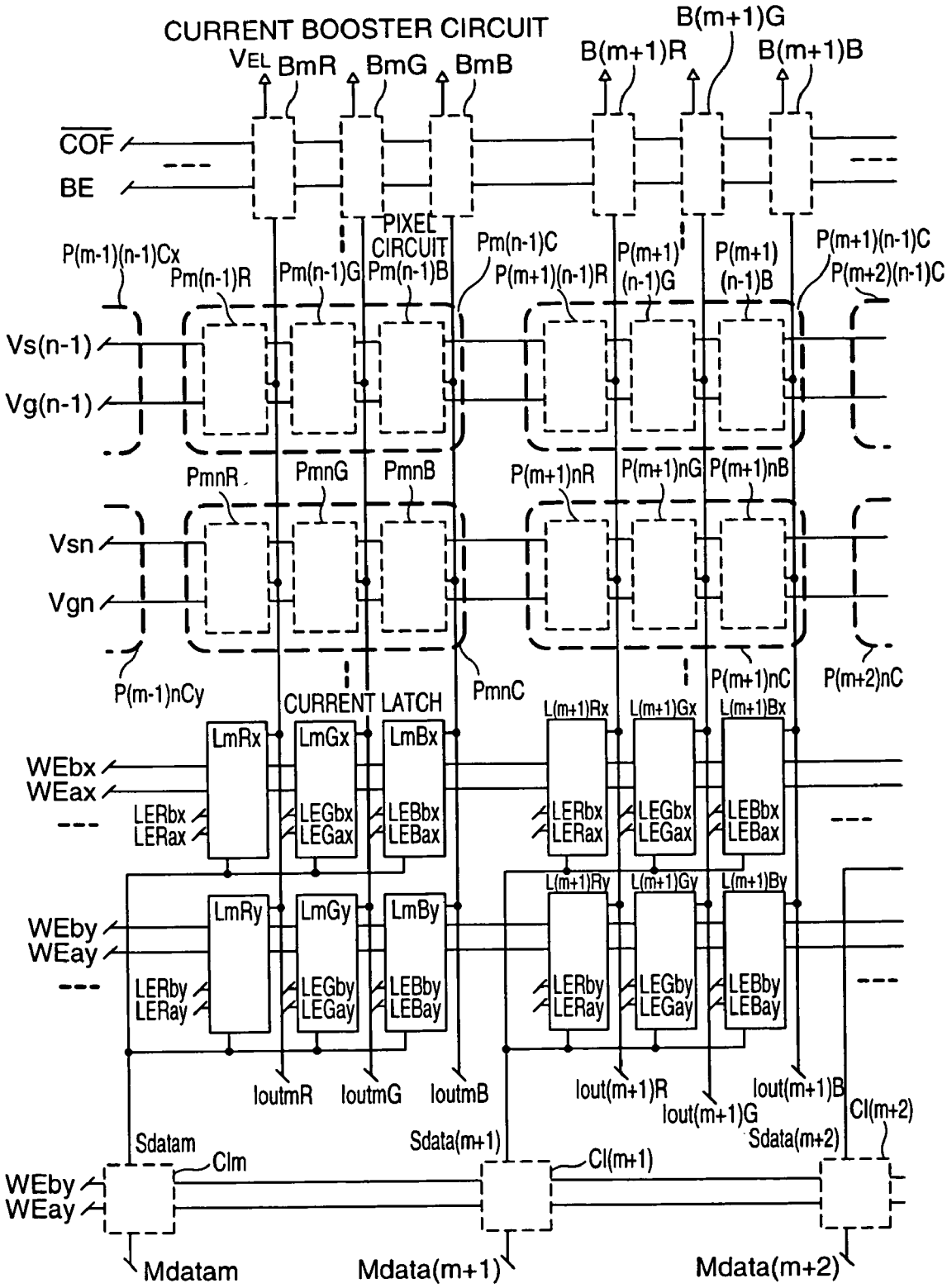
FIG. 5 is a schematic circuit diagram of a drive circuit of a second exemplary embodiment.
Figure 7:
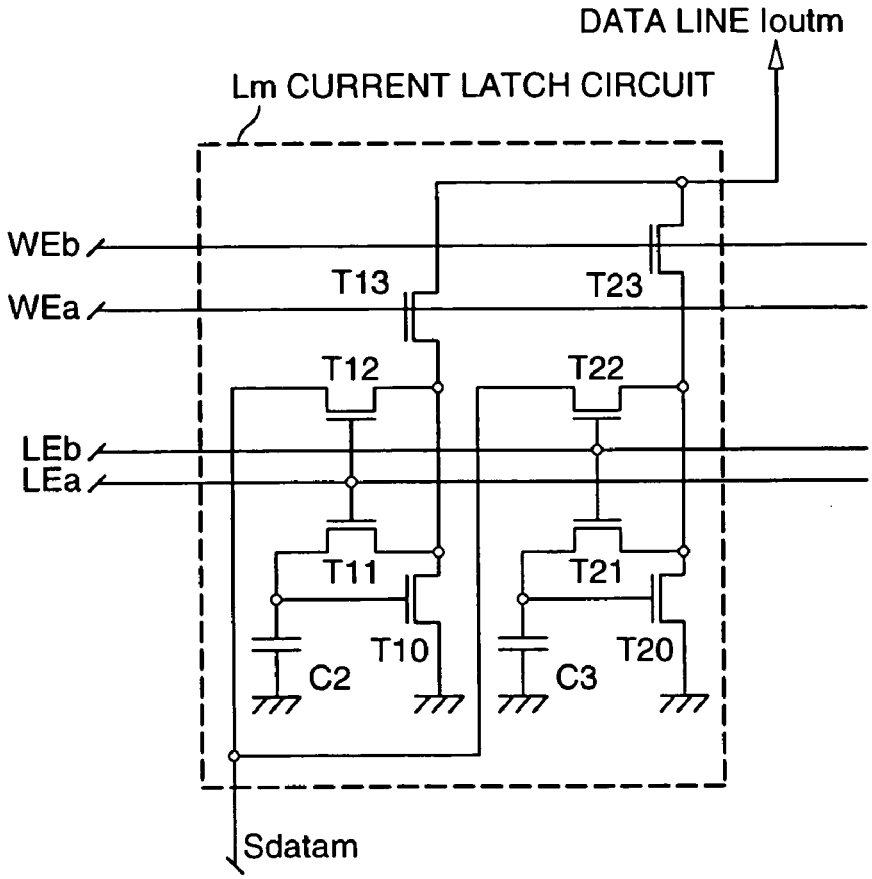
FIG. 7 is a schematic that illustrates an example of the configuration of the current latch circuit of the second exemplary embodiment.
Figure 8:
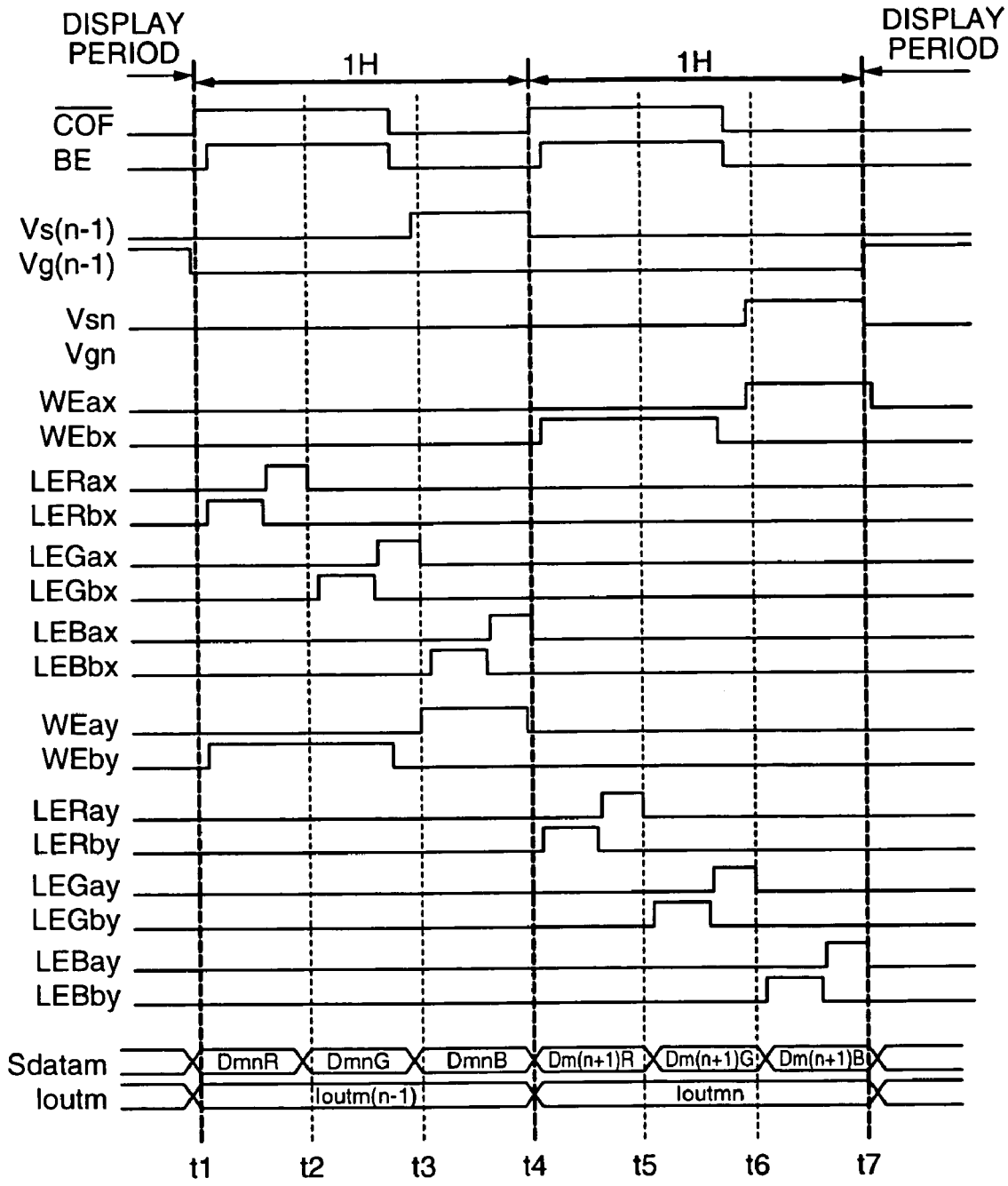
FIG. 8 is a timing chart of the drive circuit of the second exemplary embodiment.

FIG. 5 illustrates the configuration of a specific electronic apparatus of the second exemplary embodiment, and FIG. 8 is a timing chart of the operation of the electronic apparatus. FIG. 5 illustrates a color pixel PmnC to perform color displaying, a current latch circuit Lm to supply a current to the color pixel, a D/A converter CIm, and a current booster circuit Bm. The blocks, such as the pixel circuit, the current booster circuit, and the constant-current output circuit (D/A converter) CIm (indicated by broken lines), are similar to those of the first exemplary embodiment, and thus, a simple explanation thereof is given. FIG. 7 illustrates an example of the circuit diagram of the current latch circuit Lm.

The configuration of the second exemplary embodiment is different from that of the first exemplary embodiment in the following points. The current latch circuit Lm, which is a new element, is disposed between the D/A converter CIm and the pixel circuit Pmn. That is, the electronic apparatus operated by the driving method of the present invention is formed of the D/A converter CIm, the current latch circuit Lm, the pixel circuit PmnC, and the current booster circuit Bm.

The current latch circuit Lm has a function as a booster current supply device implemented in cooperation with the D/A converter CIm and a function of latching and outputting a constant current output from the D/A converter CIm. The current latch circuit Lm also has a function of converting an electric signal, which corresponds to a final program current that has been serially formed and transmitted in a time division multiplexing manner from the D/A converter CIm, into a parallel signal and outputting it, and has a double buffer function of ensuring the maximum time to program a current into the pixel circuit. In particular, in the second exemplary embodiment, grayscale display data of the three primary colors for color displaying, i.e., R (red), G (green), and B (blue), are treated as one unit. However, the present invention is not restricted to this arrangement.

The color pixel PmnC is formed of the same number of pixel circuits as the number of primary colors. In this example, pixel circuits PmnR, PmnG, and PmnB corresponding to R (red), G (green), and B (blue), respectively, form a single color pixel PmnC. The configurations of all the pixel circuits are the same, and as described in the first exemplary embodiment of the present invention, the pixel circuit is provided with a circuit which corresponds to the current program method of retaining the value of a program current supplied from a data line and of causing an electro-optical device, i.e., an EL device, to emit light by using the retained current value.

The current booster circuits BmR, BmG, and BmB have the same circuit configuration as that described in the first exemplary embodiment, and cause a boost current to flow in the data lines in cooperation with the current latch circuit Lm. It is preferable that the ratio of the current output capacity of the booster transistor T33 and that of the transistor T1 of the pixel circuit is almost equal to the ratio between the current output capacity of a boost-current output transistor T20 of the current latch circuit Lm and that of a program-current output transistor T10 of the current latch circuit Lm.

According to the configuration of the electronic apparatus of the second exemplary embodiment, R, G, and B grayscale display data are output in a time division manner from a display memory (not shown) (see FIG. 1) to the corresponding display memory output line Mdatam by dividing one horizontal period into three periods. In the D/A converter CIm, two D/A converters, i.e., a first current output circuit D/Aa and a second current output circuit D/Ab, receive the grayscale display data, and generate a program current and a boost current, respectively, based on a common reference current source (not shown). When a write enable signal WEa or WEb is supplied for each time division period, the transistor T10 or T20 becomes in a conducting state in the D/A converter CIm, as described with reference to FIG. 3, and the program current or the boost current is output from the corresponding current output circuit to a serial data line Sdatam as analog display data. As in the first exemplary embodiment, in the first half of each time division period, the boost current is supplied to the current latch Lm via the serial data line Sdatam. In the second half of the period, only the program current is supplied so that a precise current value is temporarily latched in the current latch Lm. Accordingly, the program current can be rapidly and precisely supplied from the drive controller 2 to the display circuit 1, and also, the number of connecting terminals can be reduced in proportion to a certain level of time division multiplexing (⅓ in this example).

Figure 6:
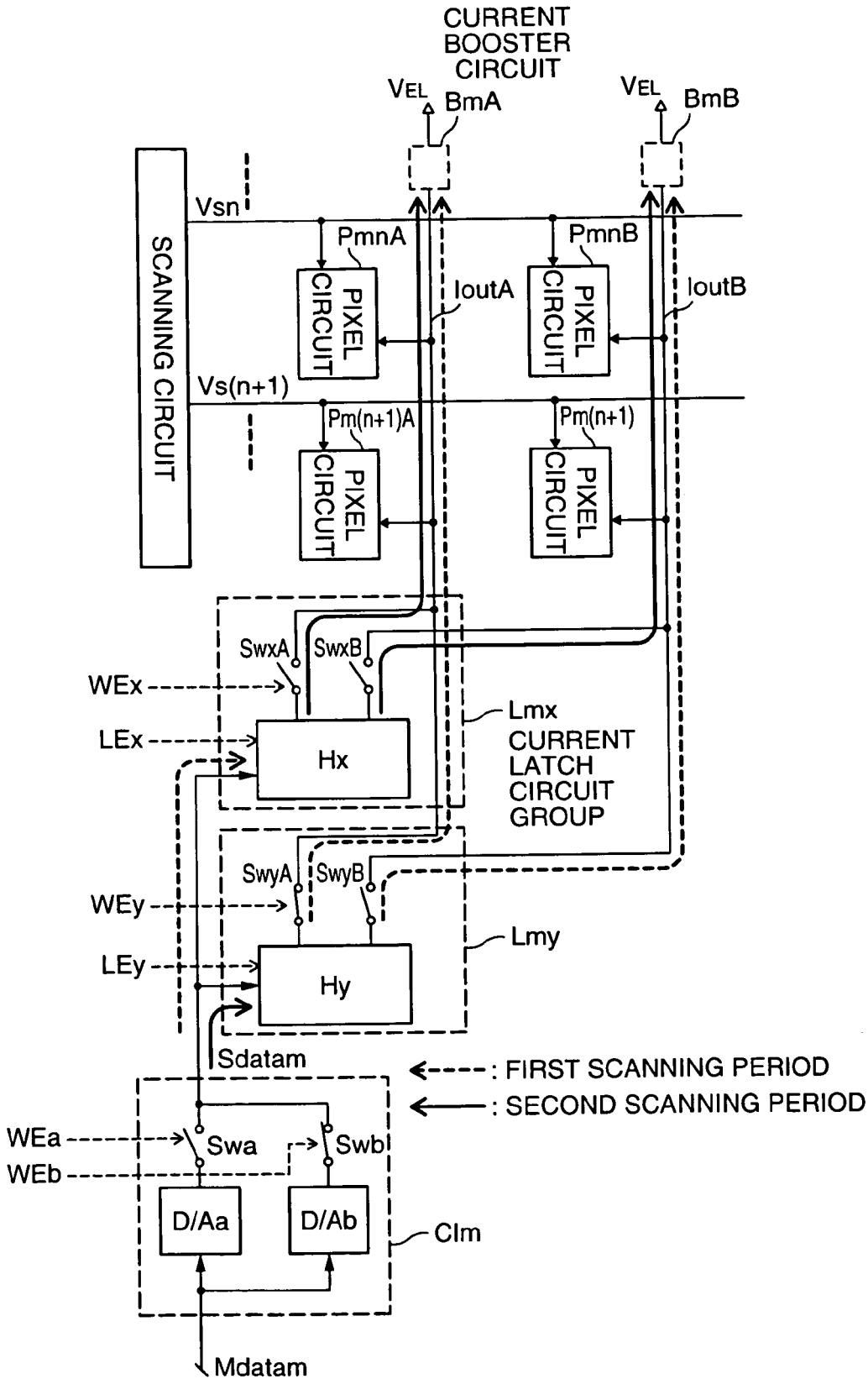
FIG. 6 is a schematic that illustrates an operation principle of a double-buffer current latch circuit of the second exemplary embodiment.

Details of a double buffer structure in the current latch circuit Lm of the second exemplary embodiment are given below. The operation principle of the double buffer in this exemplary embodiment is described with reference to FIG. 6. The current latch circuit Lm has a double buffer structure in which two similar circuits are disposed to output currents to one data line Ioutm. A pair of current latch circuits are provided for one data line. That is, current latch circuit groups Lmx and Lmy are connected in parallel with the data line Ioutm. In FIG. 5, the current latch circuit group Lmx includes current latch circuits LmRx, LmGx, and LmBx, and the current latch circuit group Lmy includes current latch circuits LmRy, LmGy, and LmBy. The latch circuits Lmx and Lmy, which form a pair of current latch circuit groups, are connected to the same serial data line Sdatam, and are able to latch analog data from the serial data line by latch enable signals LEx and LEy, which are enabled with different times. Even in the same current latch circuit group, current latch circuits for different pixels (for example, LmRx and L(m+1)Rx) are connected to different serial data lines Sdata. The control circuit 23 (see FIG. 1) adjusts the timing of a write enable signal WE and a latch enable signal LE in the following manner. While one latch circuit group latches the above-described input analog data, the other latch circuit group outputs a program current to the data line Iout. More specifically, in the first scanning period in FIG. 6, since the write enable signal WEx is disabled, and the latch enable signal LEx is enabled, the current latch circuit group Lmx latches analog data in the serial data Sdatam. In the first scanning period, since the write enable signal WEy is enabled, and the latch enable signal LEy is disabled, the current latch circuit group Lmy prohibits the latching of data, and also, a current value corresponding to the analog data latched in the latch circuit is output to data lines IoutmA and IoutmB. In the subsequent second scanning period, the relationship between the latch operation and the current output is reversed between the two current latch circuit groups. By repeating this operation, the current program time for one pixel can be ensured for one scanning period. It is thus possible to effectively implement the booster pixel circuit program of the present invention even in a TFT circuit having a low switching speed.

A detailed operation of the second exemplary embodiment shown in FIG. 5 is described with reference to FIG. 7 and the timing chart of FIG. 8. The timing chart of FIG. 8 mainly illustrates two horizontal scanning periods (2H) of a plurality of horizontal scanning periods H which form a frame period to display images. During the two horizontal scanning periods (2H), analog display data is sent and current programming is performed for the scanning line n. The second half 1H of the two horizontal scanning periods corresponds to the current program period. In this exemplary embodiment, during the current program period, the control circuit causes the light-emission control line Vgn to be in the non-selection state, and stops the light emission of the organic EL device OELD.

Analog display data corresponding to the grayscales of the primary colors are output to the serial data line Sdatam in a time division manner. The first half (time t1 to t4) of 2H for performing the latch operation is divided in a time division multiplexing level of the serial data line (in this example, three, which is equal to the number of primary colors). In each divided period, the control circuit outputs a latch enable signal so that data corresponding to each primary color is latched.

More specifically, at time t1, when analog display data concerning the red color is sent to the serial data line Sdatam, the latch enable signal LERb is enabled. Accordingly, transistors T21 and T22 of LmRx in the current latch circuit group Lmx become in a conducting state, causing a boost current of the analog display data DmnR to flow into a transistor T20 from the serial data line Sdatam. The latch enable signal LERb becomes disabled, and at the same time, the gate-source voltage of the transistor T20 is stored in a capacitor C3. Thereafter, the latch enable signal LERa becomes enabled, and the program current of the analog display data DmnR flows in the serial data line Sdatam. At time t2 in which the latch enable signal LERa becomes disabled, the gate-source voltage used to supply a more precise program current by the transistor T10 is stored in a capacitor C2. Upon completion of current latching for the red color, current latching for the green color DmnG is started at time t2, and current latching for the blue color DmnB is started at time t3. Upon completion of latching for the three primary colors, the first half of the current program period is finished. Since the write enable signals WEby and WEay are sequentially enabled from time t1 to t4, the current latch circuits LmRy, LmGy, and LmBy supply analog display data Ioutm(n−1)R, Ioutm(n−1)G, and Ioutm (n−1)B to data lines IoutR, IoutG, and IoutB, respectively.

Subsequently, from time t4, the current program period for supplying a current from the current latch circuit group Lmx to the pixel circuit PmnC is started. After time t4, the control circuit enables the write enable signal WEbx so that a boost current is output from the transistor T20 to the data line Ioutm until immediately before time t6. At time t4, the latching of the current values for all the primary colors has already completed, and the write enable signal is simultaneously supplied to all the primary colors. Accordingly, the corresponding currents are output to the data lines IoutmR, IoutmG, and IoutmB of the primary colors. Because of this boost current, even in the low-grayscale display area, i.e., even when the target current value is small and it thus takes time to program such a small current value, the gate voltage of the transistor T1 can substantially reach the target current value in a short period of time. When the boost period is finished immediately before time t6, the control circuit disables the write enable signal WEbx for the boost current so as to stop the supply of the boost current from the transistor T20. Thereafter, the control circuit enables the write enable signal WEax, and simultaneously selects the select line Vsn so as to write a current into the pixel circuit. In the remaining second half of the current program period (t6 to t7), only the program current is supplied to the pixel circuit PmnC. According to this operation, the target current value can be precisely programmed.

In the current latch circuit group Lmy, an operation similar to that of the current latch circuit group Lmx is performed such that the latching and the writing of a program current are performed with a timing displaced from the timing of the current latch circuit group Lmx by one scanning period.

Upon completion of the current program period at time t7, the control circuit selects the light-emission control line Vgn so as to cause a current to flow into the organic EL device OELD of the pixel circuit Pmn. Thus, the program current period is shifted to the display period. In this case, programming by using the enhanced current value from the corresponding data lines has been completed in the pixel circuit PmnR, PmnG, and PmnB of the primary colors, and a current having the improved value is supplied, thereby causing the organic EL device OELD of the corresponding colors to emit light with an improved luminance level associated with the enhanced current value. As a result, the light emission color of the color pixel PmnC changes according to the difference of the luminance level of the three primary colors, thereby allowing the color pixel PmnC to emit light with an improved color.

As described above, according to the second exemplary embodiment, the number of data lines to connect the drive controller 2 and the display circuit 1 can be considerably reduced, and the data lines can be connected with a low density, such as several times lower than the dot pitch or smaller. Accordingly, the manufacturing cost can be reduced, and the reliability can be enhanced. Additionally, high-definition display can be implemented without being restricted by the connecting pitch.

Third Exemplary Embodiment

A third exemplary embodiment is provided with a mode that is further developed from the second exemplary embodiment so as to increase the grayscale (luminance) adjusting range, which is an object of the present invention. In particular, in the third exemplary embodiment, considering that an organic EL device is able to perform μsec-order fast switching, an organic EL device is pulse-driven by using the light-emission control line Vgn of the pixel circuit described in the first or second exemplary embodiments.

Figure 9:
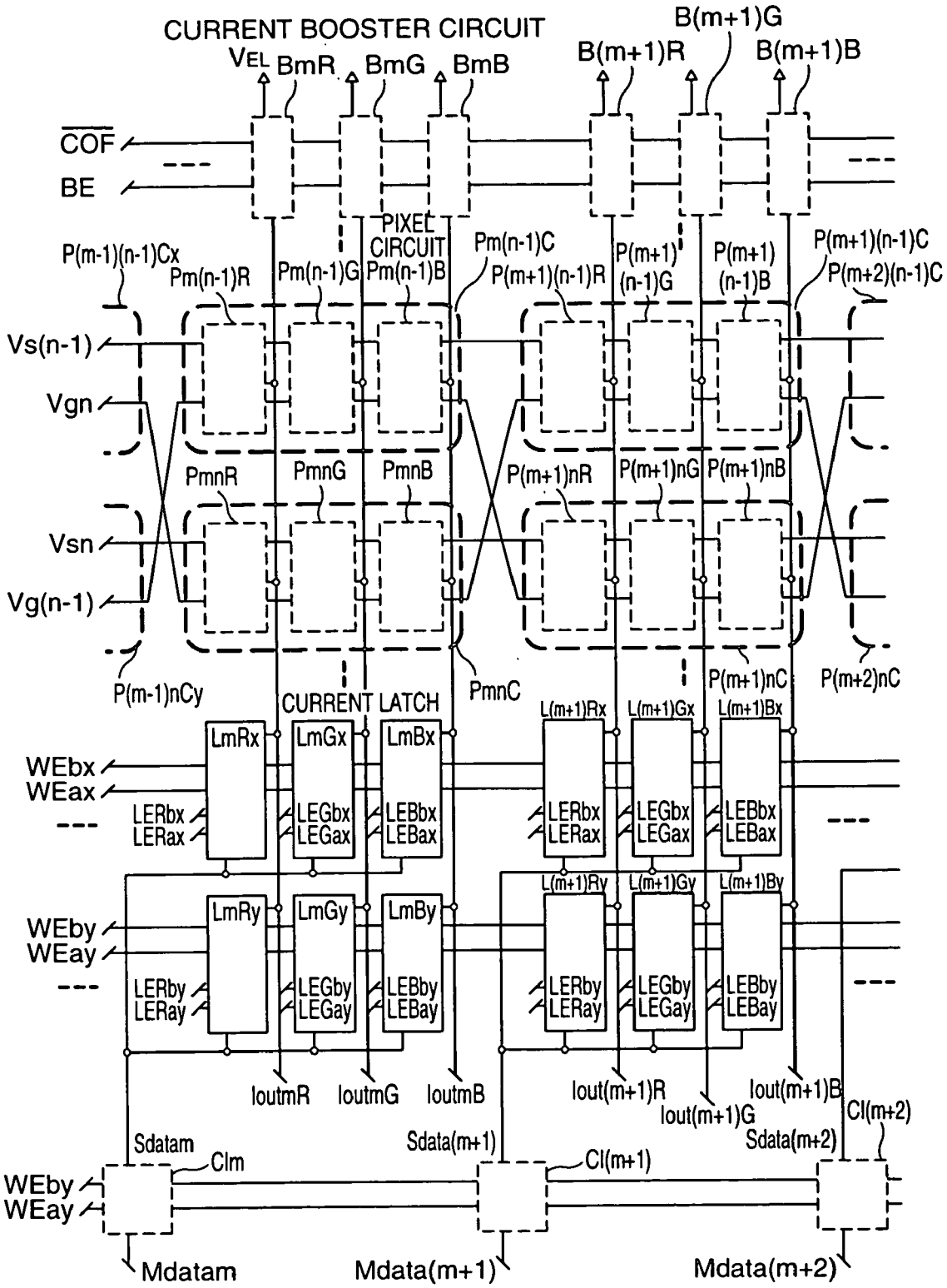
FIG. 9 is a schematic circuit diagram of a drive circuit of a third exemplary embodiment.
Figure 10:
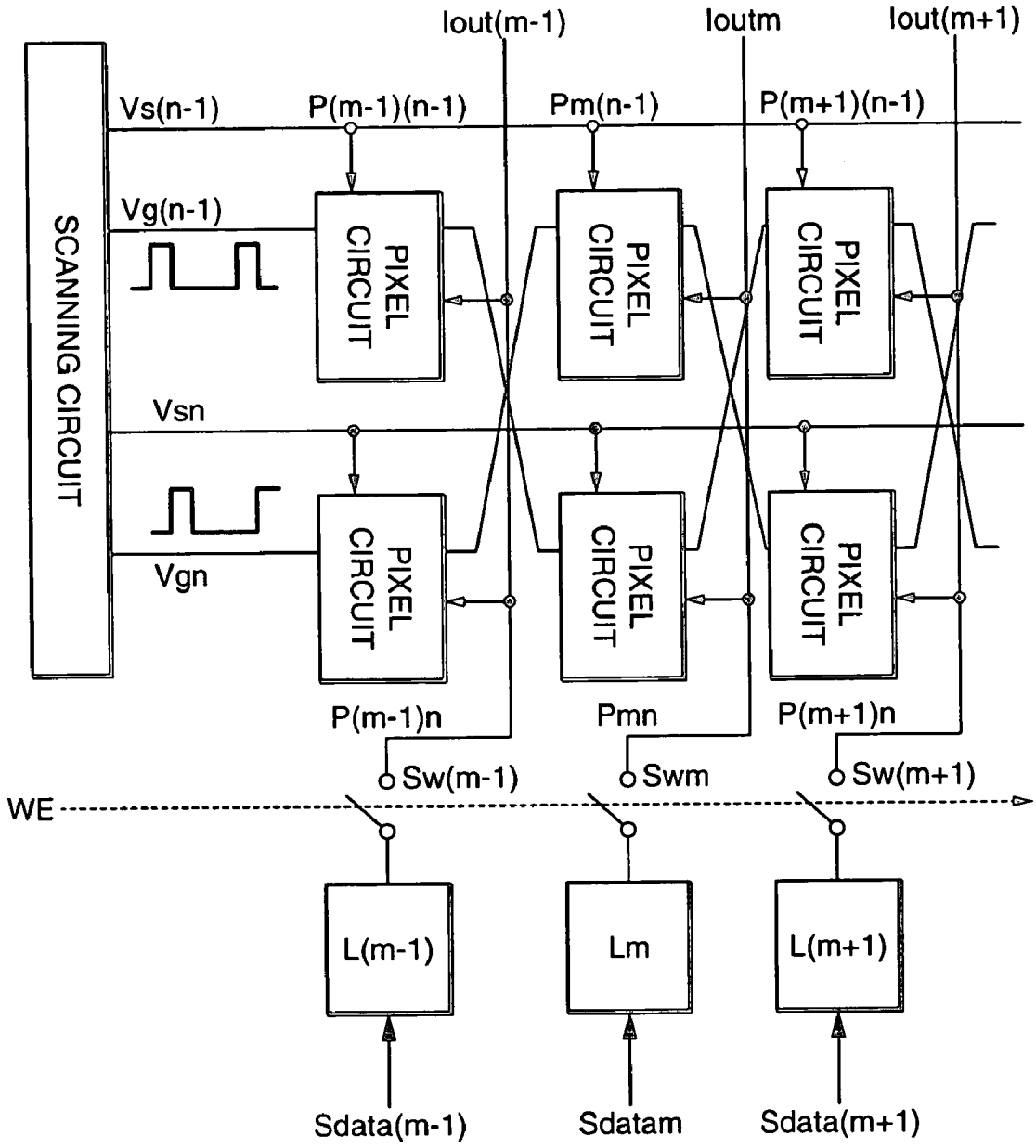
FIG. 10 is a schematic that illustrates the relationship between pixel circuits in pulse driving of the third exemplary embodiment.
Figure 11:
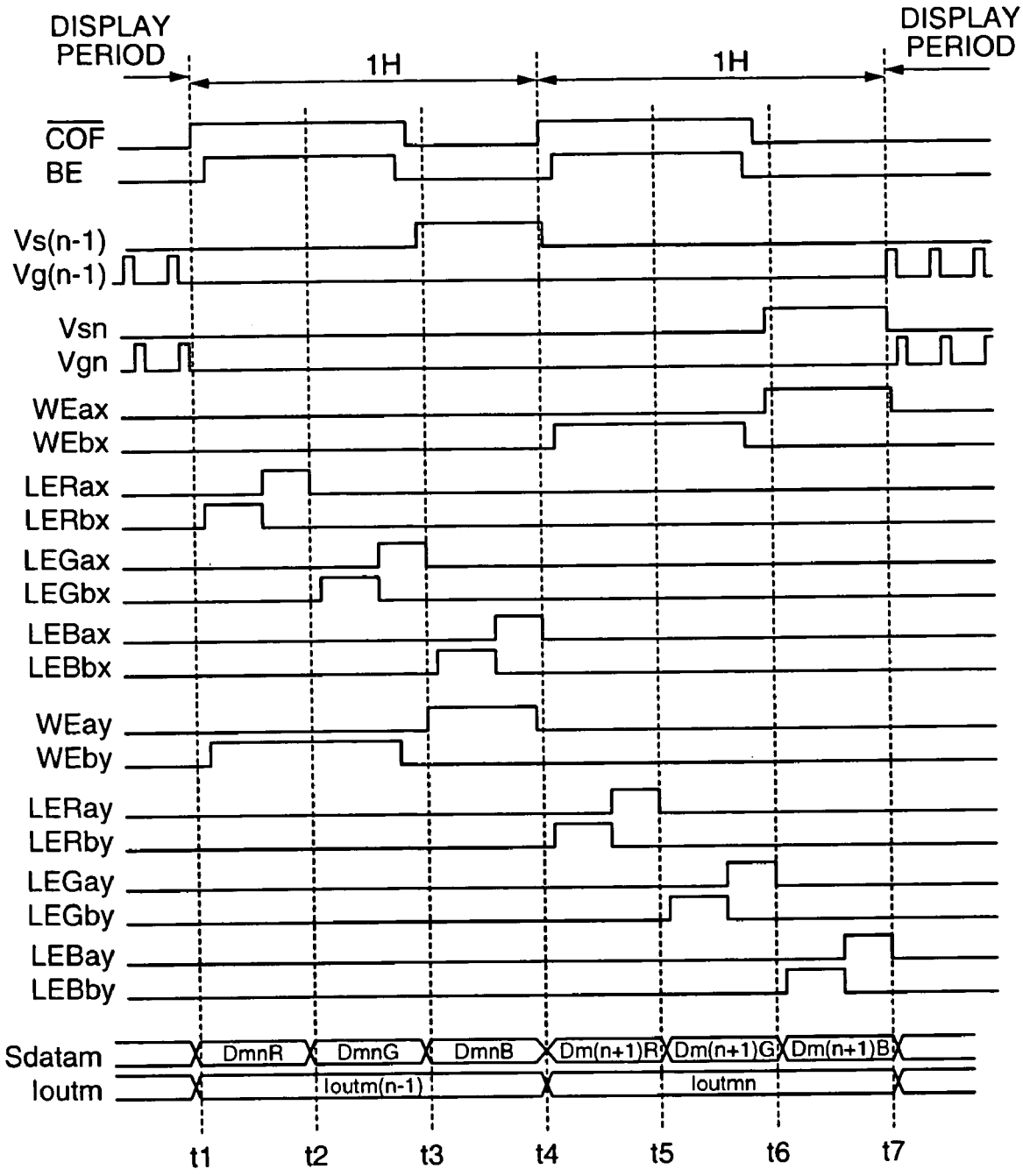
FIG. 11 is a timing chart of the drive circuit of the third exemplary embodiment.

FIG. 9 is a schematic of a drive circuit of the third exemplary embodiment. FIG. 10 illustrates the principle of the third exemplary embodiment. FIG. 11 is a timing chart of the drive circuit of the third exemplary embodiment. The portions shown in FIGS. 9 and 11 that differ from those of the second exemplary embodiment are a control method for the light-emission control lines Vgn and Vg(n−1) of the pixel circuits and the connection of the light-emission control lines to the pixel circuit. In FIG. 9, the light-emission control lines Vgn and Vg(n−1) are crossed between two adjacent scanning lines n and n−1 for color pixels. The light-emission periods of color pixels disposed adjacent to each other in the horizontal and vertical directions are controlled by different light-emission control lines. Pulse light-emission control signals having pulses in which light-emission periods are close or adjacent to each other are supplied to the adjacent light-emission control lines Vgn and Vg(n−1) during the display period. Although the number of pulses of a pulse light-emission control signal is preferably more than one during one frame period, a single pulse may suffice. The other elements of the circuit configuration and the operation are the same as those of the second exemplary embodiment, and an explanation thereof is thus omitted.

The operation principle of the third exemplary embodiment has the following characteristics. The operation principle of pulse control for light emission in this exemplary embodiment is described below with reference to FIG. 10. In this exemplary embodiment, the control circuit 23 (see FIG. 1) supplies pulses (light-emission control signals) having inverted phase portions, which are close or adjacent to each other, to the light-emission control lines during the display period. With this arrangement, pulses to be supplied to pixels Pxn and Px(n−1) adjacent to each other in the vertical (column) direction have inverted phase portions close or adjacent to each other. A pair of light-emission control lines Vgn and Vg(n+1) corresponding to the above-described pair of scanning lines are crossed for the corresponding adjacent color pixels. With the above-described arrangement, pulses to be supplied to color pixels PmnC and P(m+1)nC adjacent to each other in the horizontal (row) direction have inverted phase portions that are close or adjacent to each other. Accordingly, even when organic EL devices are caused to emit light around the frame frequency by the light-emission control lines, the brightness fluctuation area results in a checkerboard pattern, and is compensated by adjacent pixels, thereby reducing or preventing the occurrence of side effects, such as flicking and a false outline. Also, the fluctuations in the pixel source voltage caused by turning the pixels ON and OFF can be canceled out each other, thereby decreasing the deterioration of the uniformity of the display.

In this exemplary embodiment, the control circuit performs control so that pulses having predetermined duty ratios are continuously output to the light-emission control lines during the display period. In this case, since measures against flickering are taken, as described above, the occurrence of flickering can be reduced or prevented even when the frequency of a pulse to be output to each light-emission control line Vgn is changed. It is also possible to adjust the brightness of a pixel by changing the duty ratio (pulse width). In a low-grayscale display area with decreased brightness, the current value to be programmed is small so as to decrease the S/N ratio, and thus, images to be displayed may become unclear. According to the configuration of this exemplary embodiment, however, the brightness can be decreased by the pulse frequency or the duty ratio. This means that the brightness of the overall display screen can be adjusted by the pulse frequency or the duty ratio of the light-emission control line without the need to change the program current value. Accordingly, sharp images with a high S/N ratio can be displayed since it is not necessary to decrease the program current even in a low-grayscale display area or a low-luminance-level area. The above-described configuration may be employed independently of the boost program method of the first or second exemplary embodiments. However, by the use of this configuration with the boost program method, a wider grayscale (luminance) adjusting range can be obtained than that by the single use of this configuration.

A detailed operation of the third exemplary embodiment shown in FIG. 9 is now described with reference to the timing chart of FIG. 11. The timing chart of FIG. 11 mainly illustrates two horizontal scanning periods H of a plurality of horizontal scanning periods which form a frame period to display images, and current programming is performed in the two horizontal scanning periods H for scanning lines n and n−1.

As shown in the example of FIG. 11, the pulse driving cycle is suitably set in accordance with a display demand, from a few μs to a fraction of the frame cycle. Accordingly, since the average luminance of the pixels is decreased, in order to obtain the same level of luminance (grayscale), the program current value can be advantageously increased compared to when pulse driving is not performed.

In each of the current latch circuits Lmx and Lmy, one of the horizontal scanning periods 2H serves as a latch processing period, and the other period serves as a period to output a current latched to provide current programming to the data lines. During the latch processing period and the current output period (current program period) 2H, the control circuit causes the light-emission control line Vgn to the non-selection state so as to stop the light-emission of organic EL devices OELD. However, the light emission must be strictly stopped only during the current program period to supply a current to the pixel circuits. The light-emission processing in the pixel circuits may be continued, simultaneously with the latch processing for the current latch circuit. Accordingly, the control circuit may set the period to stop light emission by the light-emission control signal for each scanning line. Upon completion of the current program period, the control circuit selects the light-emission control line Vgn so as to cause a current to flow into the organic EL device OELD of the pixel circuit Pmn.

According to the third exemplary embodiment, the pulse phases of the light-emission control signals that are output to the light-emission control lines Vgn and Vg(n−1) are inverted, thereby reducing or preventing the occurrence of flickering between the vertical pixels (PmnC and Pm(n−1)C). Since the light-emission control lines Vgn and Vg(n−1) are crossed for the corresponding color pixels, the occurrence of flickering is also prevented between the horizontal pixels (PmnC and P(m+1)nC). It is also possible to control the brightness of the display area by changing the pulse frequency or the duty ratio of the light-emission control signal.

Fourth Exemplary Embodiment

This exemplary embodiment relates to an electronic system provided with the electronic apparatus of the above-described exemplary embodiments using electro-optical devices as electronic devices.

Figure 12:
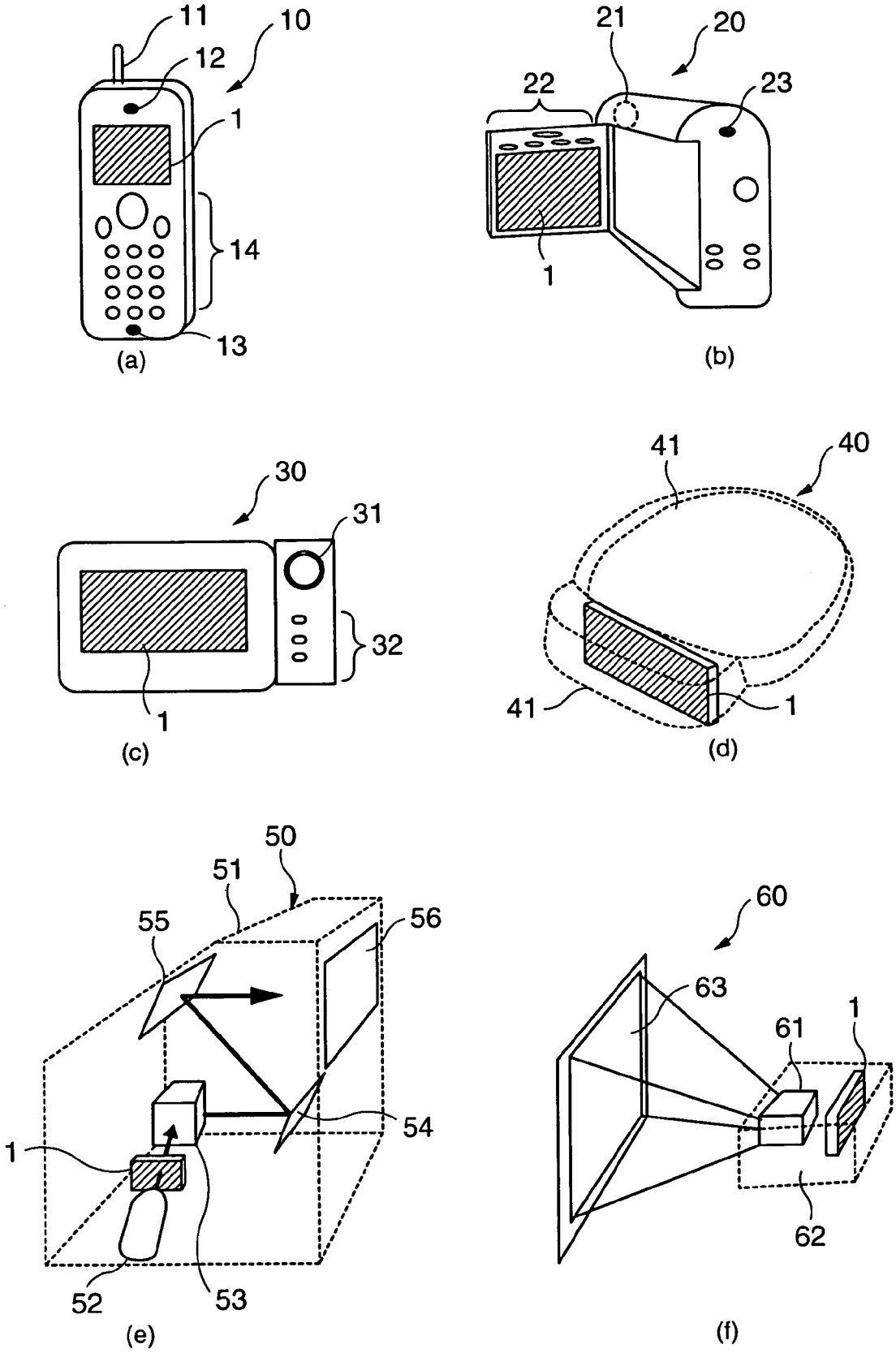
FIGS. 12(*a*)-12(*f*) are schematics that illustrate examples of electronic systems of a fourth exemplary embodiment.
Figure 13:
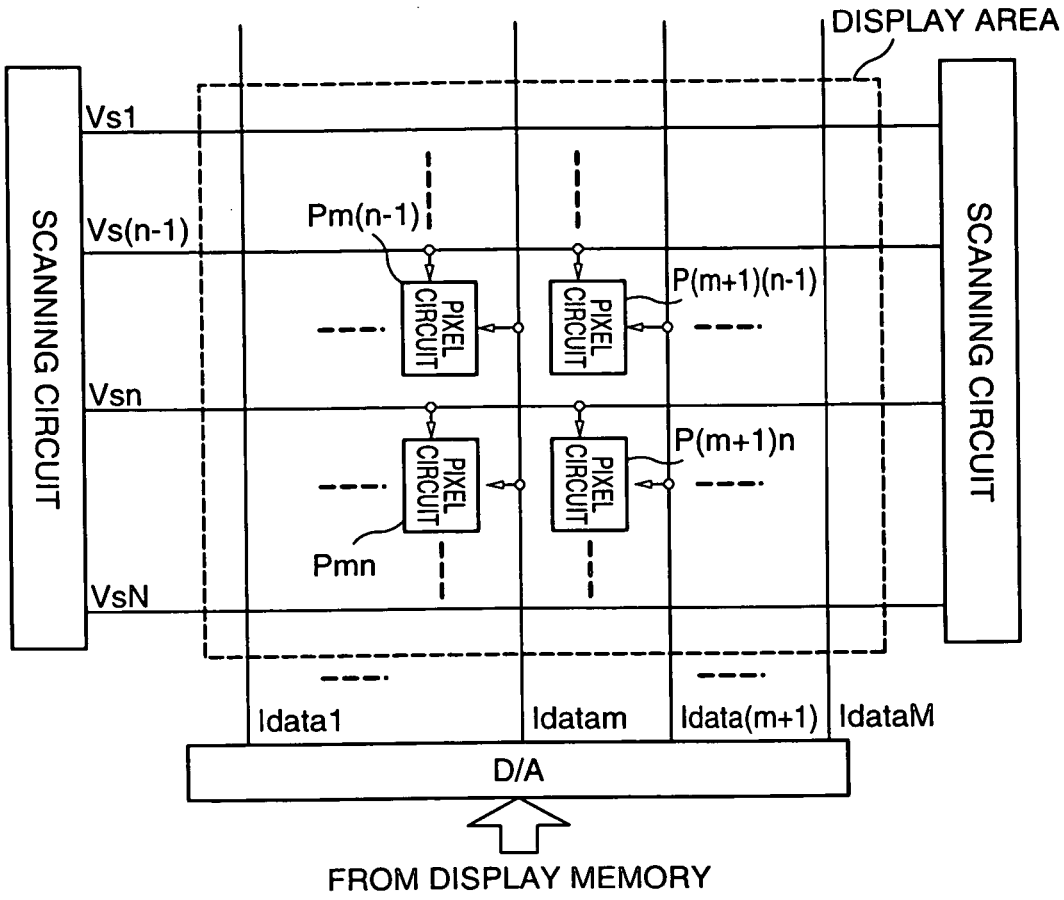
FIG. 13 is a schematic illustrating a display apparatus based on an active-matrix driving method.

FIGS. 12(*a*)-12(*f*) illustrate examples of the electronic system to which an electro-optical apparatus 1 provided with the electronic apparatus of the present invention can be applied.

FIG. 12(*a*) illustrates an example in which the electro-optical apparatus 1 is applied to a cellular telephone. The cellular telephone 10 includes an antenna 11, an audio output unit 12, an audio input unit 13, an operation unit 14, and the electro-optical apparatus 1. Accordingly, the electro-optical apparatus of the present invention can be used as a display unit of a cellular telephone.

FIG. 12(*b*) illustrates an example in which the electro-optical apparatus 1 is applied to a video camera. The video camera 20 includes an image receiver 21, an operation unit 22, an audio input unit 23, and the electro-optical apparatus 1 of the present invention. Accordingly, the electro-optical apparatus of the present invention can be used as a finder or a display unit of a video camera.

FIG. 12(*c*) illustrates an example in which the electro-optical apparatus 1 is applied to a portable personal computer. The computer 30 includes a camera 31, an operation unit 32, and the electro-optical apparatus 1 of the present invention. Accordingly, the electro-optical apparatus of the present invention can be used as a display unit of a computer.

FIG. 12(*d*) illustrates an example in which the electro-optical apparatus 1 is applied to a head mount display. The head mount display 40 includes a band 41, an optical-system housing 42, and the electro-optical apparatus 1 of the present invention. Accordingly, the electro-optical apparatus of the present invention can be used as an image display source of a head mount display.

FIG. 12(*e*) illustrates an example in which the electro-optical apparatus 1 is applied to a rear projector. The projector 50 includes a housing 51, a light source 52, a synthetic optical system 53, mirrors 54 and 55, a screen 56, and the electro-optical apparatus 1 of the present invention. Accordingly, the electro-optical apparatus of the present invention can be used as an image display source of a rear projector.

FIG. 12(*f*) illustrates an example in which the electro-optical apparatus 1 is applied to a front projector. The projector 60 includes an optical system 61 and the electro-optical apparatus 1 in a housing 62, and is able to display images on a screen 63. Accordingly, the electro-optical apparatus of the present invention can be used as an image display source of a front projector.

The electro-optical apparatus provided with the electronic apparatus of the present invention is not restricted to the above-described examples, and may be applicable to any electronic system that can be used for an active-matrix display apparatus. For example, the electro-optical apparatus may include television receivers, car navigation systems, POS, personal computers, facsimile machines provided with display functions, electronic guideboards, information panels for transportation vehicles, game machines, control panels for machine tools, electronic books, and portable devices, such as portable TV and cellular telephones, for example.

MODIFIED EXAMPLES

The present invention is not restricted to the above-described exemplary embodiments, and can be modified in various modes.

For example, in the first through third exemplary embodiments, the output capacity of the boost current supply circuit, which serves as a second output device, is changed according to the display grayscale. Alternatively, the grayscales may be largely divided into a plurality of ranges, such as high, middle, and low levels, and the output capacity of the second output means may be switched according to the divided grayscale. With this modification, the present invention can provide advantages over the related art. In this case, the second output device may output the center value of predicted target voltages of the data lines. With this configuration, the provision of the current booster circuit can be eliminated. The second output device may preferably be formed as a voltage-output D/A converter, and in the first half of the current program period, the second output device is operated such that the voltage of the data line can substantially reach the target voltage, and, in the second half of the current program period, the second output device performs more precise programming than the first output device.

Alternatively, a transfer switch circuit, which is operated with the same timing as the booster transistor T33 shown in FIG. 3, may be disposed between the selection supply means and the data line and on the same active-matrix on which the booster transistor T33 is formed. With this arrangement, the first output and the second output can be switched with high precision.

The present invention offers at least the following advantages.

According to the present invention, since one of or both the first output and the second output can be selectively output, instead of or in addition to the first output, which is the major output, the second output can be supplied as the auxiliary output according to the purpose of the drive circuit. When the present invention is applied to, for example, a display device that requires current programming, even in a low-grayscale display area having a small program current, a boost current, which is higher than a program current, can be used as the auxiliary output so that sharp images can be displayed without being influenced by noise. Additionally, because of this high current, the target current value can be reached in a short period of time without deviating from the target current value, thereby making it possible to display images with precise brightness.

According to the present invention, since the output means having the boost current program function and the double buffer function is provided for each data line, the number of data lines can be considerably decreased. Accordingly, when the present invention is applied to, for example, a display apparatus with a restricted connecting pitch, a high-definition display apparatus can be implemented.

According to the present invention, pulses to be supplied to adjacent pixels in the vertical direction have inverted phase portions that are close or adjacent to each other. Accordingly, even with an increased pulse width, the fluctuations of brightness are compensated by the adjacent pixels, thereby reducing or preventing the occurrence of flickering. Also, a pair of light-emission control lines is crossed between adjacent pixels in the horizontal direction, pulses to be supplied to the adjacent pixels have inverted phase portions that are close or adjacent to each other. Thus, as in the vertical direction, even with an increased pulse width, the fluctuations of brightness are compensated by the adjacent pixels, thereby reducing or preventing the occurrence of flickering. The fluctuations of the pixel source voltage caused by turning pixels ON and OFF can be canceled out, thereby decreasing the deterioration of the uniformity of the display. This pulse driving method may be used independently of the first or second exemplary embodiments. According to this method, the grayscale (luminance) adjusting range can be increased.

As is understood from the foregoing description, according to the present invention, in response to an enhancement in the conversion efficiency or the aperture ratio of electronic devices, for example, electro-optical transducer devices, the grayscale and the display brightness can be controlled with high precision in a wider range. Additionally, since fast current programming can be implemented, the present invention is also effective for high-resolution display.

The invention claimed is:

1. An electronic apparatus, comprising:

unit circuits including electronic devices;

data lines connected to the corresponding unit circuits;

a constant-current output circuit provided with a pair of D/A converters including a first output device and a second output device, the first output device outputs, as a first output, a current or a voltage corresponding to a data signal, the second output device outputs, as a second output, a current or a voltage that is higher than the first output;

a current booster circuit, as a load device, causing a boost current to flow into the data lines in cooperation with the constant-current output circuit; and a selection supply device to select one of or both the first output from the first output device and the second output from the second output device, and to supply the selected output to the data line.

2. The electronic apparatus according to claim 1, the selection supply device including at least one switching device.

3. The electronic apparatus according to claim 1, the ratio between a current driving capacity of the unit circuit and a current driving capacity of the current booster circuit being substantially equal to the ratio between a current output capacity of the first output device and a current output capacity of the second output device.

4. The electronic apparatus according to claim 1, the current booster circuit being disposed at a distal end of the data line when viewed from the second output device.

5. The electronic apparatus according to claim 1, the current booster circuit receiving a current flowing in the data line when the selection supply device selects the second current from the second output device, and outputting the selected second current to the data line.

6. The electronic apparatus according to claim 1, the select supply device selecting only the first output from the first output device, and supplying the first output to the data line at least during a predetermined last period portion of an output period for which an output is supplied to the electronic device.

7. The electronic apparatus according to claim 1, the selection supply device selecting at least the second output from the second output device at least during a predetermined first period portion of an output period for which an output is supplied to the electronic device.

8. The electronic apparatus according to claim 1, the selection supply device selecting at least the second output from the second output device, and supplying the selected output to the data line at least during a predetermined first period portion of an output period for which an output is supplied to the electronic device, and the selection supply device selecting at least the first output from the first output device, and supplying the selected output to the data line at least during a predetermined last period portion of the output period.

9. The electronic apparatus according to claim 1, the selection supply device being able to supply the output from the first output device and the output from the second output device at substantially the same portion of the data line.

10. The electronic apparatus according to claim 1, the second output device outputting, as the second output, a current or a voltage corresponding to an externally supplied data signal.

11. The electronic apparatus according to claim 1, further including a plurality of output supply devices including the first output device, the second output device, and the selection supply device for one of the data lines, and while one of the output supply devices stores a current value or a voltage value based on the data signal, at least the other one of the output supply devices supplies an output to the data line.

12. The electronic apparatus according to claim 11, the current supply device setting two adjacent horizontal scanning periods of a plurality of horizontal scanning periods to be a period to supply an output to the data line, and setting the remaining of the plurality of the horizontal scanning periods to be a period to control the unit circuit.

13. The electronic apparatus according to claim 12, a predetermined number of the electronic apparatuses forming one set, and each of the electronic apparatuses storing a current value or a voltage value based on the corresponding data signal in a corresponding one of sub-periods obtained by dividing the horizontal scanning period by a predetermined number.

14. The electronic apparatus according to claim 1, a pair of the unit circuits being connected to one of the data lines, and one of a pair of control lines to control the output of each of the electronic devices being connected to the corresponding unit circuit, and the other control line being connected to the other unit circuit; and control signals having inverted phase portions, which are close or adjacent to each other, being supplied to the corresponding control lines.

15. The electronic apparatus according to claim 14, pulses having a predetermined duty ratio being continuously output to the control lines.

16. The electronic apparatus according to claim 14, the pair of control lines being crossed for the corresponding adjacent unit circuits.

17. The electronic apparatus according to claim 14, a predetermined number of the unit circuits forming a set; and the control signals supplied to adjacent sets of the unit circuits having inverted phases, which are close or adjacent to each other, for the adjacent sets of the unit circuits.

18. The electronic apparatus according to claim 1, the electronic devices being current driving devices.

19. The electronic apparatus according to claim 1, the electronic devices being electro-optical devices.

20. An electronic system, comprising:

the electronic apparatus set forth in claim 1.

* * * * *